US012011031B1

(12) United States Patent
He et al.

(10) Patent No.: US 12,011,031 B1
(45) Date of Patent: Jun. 18, 2024

(54) DEVICE FOR REMOVING STEMS IN A CIGARETTE MAKING PROCESS AND A METHOD FOR REMOVING THE STEMS

(71) Applicant: CHINA TOBACCO YUNNAN INDUSTRIAL CO., LTD., Kunming (CN)

(72) Inventors: Banghua He, Kunming (CN); Jun Tang, Kunming (CN); Bin Yi, Kunming (CN); Bing Zhou, Kunming (CN); Wenqiang Lin, Kunming (CN); Jin Wang, Kunming (CN); Bo Cai, Kunming (CN); Xiaohua Gao, Kunming (CN); Chao Li, Kunming (CN); Guozhi Tan, Kunming (CN); Yadong Wen, Kunming (CN); Li Tang, Kunming (CN); Sidi Lin, Kunming (CN); Jielin Sun, Kunming (CN)

(73) Assignee: CHINA TOBACCO YUNNAN INDUSTRIAL CO., LTD., Kunming (CN)

( * ) Notice: Subject to any disclaimer, the term of this patent is extended or adjusted under 35 U.S.C. 154(b) by 0 days.

(21) Appl. No.: 18/444,803

(22) Filed: Feb. 19, 2024

Related U.S. Application Data

(63) Continuation of application No. PCT/CN2023/077298, filed on Feb. 21, 2023.

(51) Int. Cl.
*A24C 5/39* (2006.01)
*A24C 5/34* (2006.01)

(52) U.S. Cl.
CPC ..... *A24C 5/396* (2013.01); *A24C 5/3412* (2013.01); *A24C 5/392* (2013.01); *A24C 5/393* (2013.01)

(58) Field of Classification Search
None
See application file for complete search history.

(56) References Cited

FOREIGN PATENT DOCUMENTS

| | | | |
|---|---|---|---|
| CN | 102823936 | A | 12/2012 |
| CN | 204907895 | U | 12/2015 |
| CN | 205902790 | U | 1/2017 |
| CN | 106723294 | A | 5/2017 |
| CN | 208373581 | U | 1/2019 |
| CN | 114062366 | A | 2/2022 |
| CN | 115039905 | A | 9/2022 |
| CN | 115428978 | A | 12/2022 |
| GB | 1186802 | A | 4/1970 |

OTHER PUBLICATIONS

International Search Report dated Nov. 5, 2023; International Application No. PCT/CN2023/077298; International Filing Date Feb. 21, 2023; 5 pages; China National Intellectual Property Administration (ISA/CN), Beijing, China.

*Primary Examiner* — Phu H Nguyen
(74) *Attorney, Agent, or Firm* — Andrew D. Fortney; Central California IP Group, P.C.

(57) ABSTRACT

A stem removal device for a cigarette making process is disclosed, including a feeding unit (N1), a flexible air sorting unit (N2), a pure tobacco collection unit (N3), a tobacco conveying unit (N4), a coarse stem removal unit (N5) and a fine stem removal unit (N6). A method for removing the stems during the cigarette making process using the stem removal device is also disclosed.

6 Claims, 1 Drawing Sheet

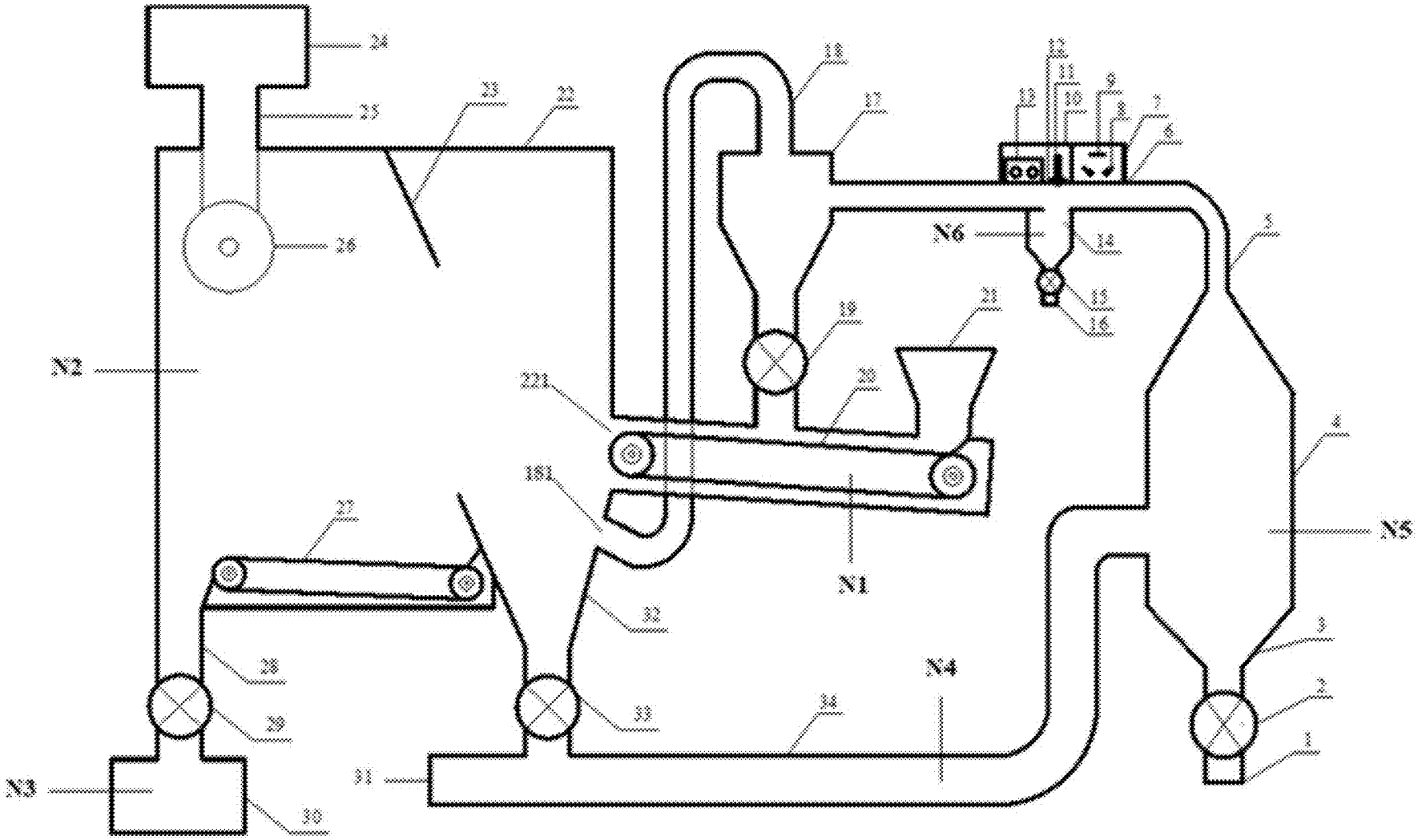

DEVICE FOR REMOVING STEMS IN A CIGARETTE MAKING PROCESS AND A METHOD FOR REMOVING THE STEMS

CROSS-REFERENCE TO RELATED APPLICATIONS

This application is a continuation of International Pat. Appl. No. PCT/CN2023/077298, filed on Feb. 21, 2023, which claims the benefit of Chinese Pat. Appl. No. 202310135502.4, filed on Feb. 20, 2023, both of which are incorporated herein by reference as if fully set forth herein.

TECHNICAL FIELD

The invention belongs to the technical field of tobacco processing technology and in particular relates to a device and a method for removing stems in a cigarette making process.

BACKGROUND

Stems are unavoidable foreign bodies in tobacco after the tobacco is cut. Stems cause losses in the subsequent rolling process and the final cigarette product. Stems should be removed before the tobacco is made into cigarette products.

According to their size, stems can be divided into fine stems (the width is not greater than 0.7 mm or the length is not greater than 1.0 mm) and coarse stems (the width is greater than 0.7 mm or the length is greater than 1.0 mm). The density properties of coarse stems and cut tobacco are very different, and the traditional wind flotation principle can basically remove the coarse stems. However, the difference between the density properties of the fine stems and the cut tobacco is relatively small, and it is difficult to remove the stems while ensuring the removal rate of the stems and reducing the false cut tobacco rate when using the traditional wind flotation principle. That is, although the removal rate of the fine stems can be improved, the tobacco content in the removed stems is also high, resulting in excessive tobacco losses.

At present, Chinese cigarette enterprises basically use flexible air separation to remove stems from tobacco, and there are generally prominent problems such as high tobacco losses, poor removal of thin stems, and large water loss (e.g., in the tobacco conveying pipes), which makes the removal or control of stems a difficult and key point for cigarette enterprises to solve urgently.

SUMMARY

To solve the above problems, the present invention is proposed.

Stem removal is an important step in the shredded cigarette tobacco production process. How to effectively and comprehensively remove the stems from cut tobacco has important practical significance for improving the purity of cut tobacco and stabilizing the quality of cigarette products. The purpose of the present invention is to address the shortcomings of existing technology and provide a device and an operating method for removing stems during the cigarette making process, which can effectively remove substantially all stems during the cigarette making process and significantly improve the purity of the shredded/cut tobacco and the quality of the shredded tobacco, and can be adapted to mass production of cigarette tobacco shredding production lines, and has good application prospects and practical significance.

The object of the present invention is achieved through the following technical solutions.

A first aspect of the present invention concerns a device for removing stems during the cigarette making process, which includes a tobacco feeding unit N1, a flexible air sorting unit N2, a pure tobacco collection unit N3, a tobacco conveying unit N4, and a coarse stem removal unit N5, a fine stem removal unit N6.

The tobacco feeding unit N1 is in the center of the stem removal device, the flexible air sorting unit N2 is on a first side of the stem removal device, the coarse stem removal unit (N5) is on a second side of the stem removal device (e.g., opposite from the first side), the fine stem removal unit (N6) is on a third side is of the stem removal device, and the tobacco-and-stem feed port of the stem delivery unit (N4) is on a fourth side of the stem removal device (e.g., opposite from the third side). The tobacco feeding unit N1 may be configured for conveying incoming (raw) tobacco and the cut tobacco after removing the stems to the flexible air sorting unit N2 for a flexible air sorting process. The tobacco feeding unit N1 may also vibrate, to loosen and/or separate the incoming tobacco and the cut tobacco without stems while conveying it to the flexible air sorting unit N2.

The flexible air sorting unit N2 may be rectangular (e.g., it comprises and/or is in the shape of a rectangular box). The pure tobacco collection unit N3 is below (e.g., at the bottom of) the rectangular flexible air sorting unit N2, and the tobacco conveying unit N4 comprises a tobacco blanking device 32 is below or at a lower side of the tobacco conveying unit N4. The flexible air sorting unit N2 is configured for air sorting and separating pure tobacco during or after the tobacco feeding unit N1 conveys the incoming tobacco and the cut tobacco without stems. The separated pure tobacco is transported to the pure tobacco collecting unit N3 for collection, and the remaining tobacco and stem mixture is transported to the tobacco conveying unit N4 for further transportation. The pure tobacco collection unit N3 is configured to collect the pure tobacco. The tobacco conveying unit N4 is configured to transport the tobacco and stem mixture pneumatically (e.g., via air flow) after separation from the flexible air sorting unit N2 to the coarse stem removal unit N5 for the coarse stem removal process. The fine stem removal unit N6 is configured to recognize fine stems in images of the tobacco and stem mixture and remove the fine stems from the mixture using a precise (air) spray, and the tobacco after removal of the fine stems is transmitted to the tobacco feeding unit N1, thereby completing a cyclic stem removal process.

The movement sequence or flow of tobacco in each of the units is as follows: raw tobacco enters the tobacco feeding unit N1 and the flexible air sorting unit N2. In the flexible air sorting unit N2, pure tobacco enters the pure tobacco collection unit N3, and the remaining tobacco and stem mixture goes into the tobacco conveying unit N4, then into the coarse stem removal unit N5 and the fine stem removal unit N6, then back into the flexible air sorting unit N2 and into the pure tobacco collection unit N3 to be collected.

Preferably, the tobacco feeding unit N1 comprises a vibrating conveying feeding device 20 and a funnel feeding device 21 (e.g., in a center or an upper and/or side portion of the stem removal device). The vibrating conveying feeding device 20 extends obliquely to a flexible air separator or sorting box 22 in a right-to-left oblique upward arrangement as shown in FIG. 1. The connection port 221 between the tobacco feeding unit N1 and the flexible air separator 22 is in a side wall of the flexible air sorting unit N2, in a lower portion (e.g., lower half) thereof.

The flexible air sorting unit N2 comprises a flexible air separator 22, a baffle 23, a dust removal device 24 and a vibrating conveying discharge device 27, wherein the baffle 23 is in on a top wall in a middle of the flexible air separator 22, and above and to a side of the connection port 221. The dust removal device 24 is above the flexible air separator 22, and may include an exhaust air outlet 26 in the flexible air separator 22 and an exhaust air pipe 25 connected to the exhaust air outlet 26. The vibrating conveying discharge device 27 is between the pure tobacco collection unit N3 and the tobacco conveying unit N4 (e.g., at a bottom of the flexible air separator (or sorting box) 22, and diagonally tilted (e.g., upward, from the tobacco conveying unit N4 to the pure tobacco collection unit N3). A first end of the vibrating conveying discharge device 27 is located adjacent to the pure tobacco discharge pipe 28, and a pure tobacco discharge air lock 29 (e.g., below and connected to the pure tobacco discharge pipe 28) is connected to the pure tobacco collection unit N3. A second, opposite end of the vibrating conveying discharge device 27 is located adjacent to (and may be attached to a middle and/or lower part outside of) the tobacco discharge device 32 (or the mouth thereof).

The pure tobacco collection unit N3 comprises the pure tobacco collection device 30, and the pure tobacco collection device 30 is connected to the pure tobacco discharge pipe 28 through the pure tobacco discharge gas lock 29.

The tobacco conveying unit N4 comprises a horizontal tobacco (and stem) conveying pipe 34. The tobacco-and-stem conveying pipe 34 is tubular, and has an upper wall at a first end that is connected with the tobacco blanking device 32 through a tobacco blanking air lock 33. The tobacco-and-stem conveying pipe 34 includes a pneumatic conveying (e.g., air) inlet 31 connected with a positive pressure air generating device (e.g., an air pump or fan).

The coarse stem removal unit N5 comprises a vertically-configured air sorting device 4, a lifting tube 5 and a coarse stem collecting cylinder 3. The lifting tube 5 may be trumpet- or horn-shaped. The air sorting device 4 is cylindrical (at least in part), and has an upper port connected to the lifting tube 5 (or an opening thereof), and a lower port connected to the coarse stem collecting cylinder 3. The coarse stem collecting cylinder 3 is connected to the coarse stem collecting tube 1 through the coarse stem collecting gas lock 2. After the right end tube of the tobacco-and-stem conveying pipe 34 is bent upward 90°, its right port is connected through the middle and lower part of the side wall of the air sorting device 4.

The fine stem removal unit N6 comprises a horizontal pneumatic conveying square pipe 6, an image recognition system 7, a fine stem removal system 10, a fine stem collecting cylinder 14 and a cyclone separator 17. The horizontal pneumatic conveying square pipe 6 may be transparent. The image recognition system 7 comprises an image acquisition camera 8 and a light source 9. The fine stem removal system 10 comprises a compressed air spray pipe 11, a high-speed solenoid valve 12 and a detection and identification signal servo controller 13. The image recognition system 7 is upstream of, but located close to, the fine stem removal system 10, and both are above the horizontal pneumatic conveying square pipe 6. The fine stem collecting cylinder 14 is below the horizontal pneumatic conveying square pipe 6 and has an upper end connected to the horizontal pneumatic conveying square pipe 6 and a lower end connected to the fine stem collecting air lock 15 (in turn, connected to the fine stem collecting pipe 16). The fine stem collecting system 10 is across the horizontal pneumatic conveying square pipe 6 from the fine stem collecting cylinder 14. The cyclone separator 17 is vertically configured, and has a lower port connected to the vibrating conveying feeding device 20 (through the purified tobacco discharge gas lock 19), and an upper port connected to the exhaust pipe 18. The exhaust pipe 18 includes a 180° bend, and is connected to a wall (e.g., the side wall of the flexible air sorting unit N2 and/or a wall of the tobacco blanking device 32) below between the connection port 221 and/or in the tobacco blanking device 32. The exhaust pipe port 181 is inclined upward. The horizontal pneumatic conveying square pipe 6 has a first port connected to the lifting tube 5 (or an upper port thereof), and a second port connected to a wall (e.g., in the middle and/or upper part[s]) of the cyclone separator 17.

Preferably, the baffle 23 is adjustable (e.g., rotatingly, horizontally, or along the left and right directions), so as to adjust the air flow direction in the flexible air separator 22 (e.g., during the flexible air sorting process).

Preferably, the raw tobacco from which the stems are removed is one or more of shredded tobacco, shredded tobacco with stems, finished tobacco, etc. (e.g., in a cigarette production line).

Preferably, the pneumatic conveying inlet 31 provides a positive pressure air velocity into the tobacco-and-stem conveying pipe 34 that ranges from 8.0 m/s to 15.0 m/s.

Preferably, the tobacco-and-stem conveying tube 34 provides a positive pressure air velocity into the air sorting device 4 that ranges from 2.0 m/s to 6.0 m/s.

Preferably, the lifting tube 5 provides a positive pressure air velocity into the transverse pneumatic conveying square pipe 6 that ranges from 13.0 m/s to 23.0 m/s.

A second aspect of the present invention discloses a method for removing stems in a cigarette making process. Using the stem removal device, the path along which the mixture of stems and tobacco moves in the stem removal device is as follows: the stem-and-tobacco mixture flows along the tobacco-and-stem conveying pipe 34 into the air sorting device 4 using positive pressure air in the tobacco-and-stem conveying pipe 34 from the pneumatic conveying inlet 31, and then the mixture (containing cut tobacco and fine stems) moves upward in the air sorting device 4 and enters the horizontal pneumatic conveying square pipe 6 through the lifting tube 5. Then it continues to move along the horizontal pneumatic conveying square pipe 6 (where the fine stems are removed) into the cyclone separator 17, and then along the exhaust pipe 18 through the exhaust pipe port 181 into the flexible air separator 22. The tobacco moves upwards in the flexible air separator 22, and then dust therefrom may enter the exhaust pipe 26 and be discharged through the exhaust pipe 25 into the dust removal device 24.

The method for removing the stem in the cigarette making process comprises the following steps:

The raw material tobacco falls onto the vibrating conveying feeding device 20 from the funnel feeding device 21 and enters the flexible air separator 22 when the vibrating conveying feeding device 20 conveys the raw tobacco obliquely upward while vibrating, due to the positive pressure wind (e.g., air flow) and the effect of gravity on the raw tobacco entering the flexible air separator 22 through the exhaust pipe 18. The raw tobacco is sufficiently loosened and separated into a majority portion of pure tobacco and a small part or portion containing a mixture of tobacco and stems, wherein the pure tobacco moves to the left in the flexible air separator 22 shown in FIG. 1, and falls on the vibrating conveying discharge device 27 due to its own weight, and then is conveyed to the pure tobacco discharging pipe 28. Finally, the pure tobacco is discharged through the discharge gas lock 29 and collected in the pure cut tobacco collection device 30.

The tobacco and stem mixture separated by the flexible air separator 22 falls into the tobacco blanking device 32 due to its own weight (gravity), and enters the tobacco-and-stem conveying pipe 34 through the tobacco blanking air lock 33. Due to positive pressure air flow entering from the pneumatic conveying inlet 31, the tobacco and stem mixture moves along the tobacco-and-stem conveying pipe 34 and enters the vertical air sorting device 4. Under the combined action of the vertical upward wind (force of positive pressure air) and its own weight (gravity), the tobacco and stem mixture is fully and loosely separated into two parts: the coarse stems and a mixture of tobacco and fine stems. The coarse stems drop to the bottom of the vertical air sorting device 4 and are discharged through the coarse stem collecting cylinder 3, the coarse stem collecting gas lock 2, and the coarse stem collecting pipe 1.

Under the action of positive air pressure, the mixture of tobacco and fine stems moves towards the top of the vertical air sorting/separating device 4, passes through the lifting tube 5, and enters into and moves through the horizontal pneumatic conveying square pipe 6. Preferably, the mixture of tobacco and fine stems passes through the horizontal pneumatic conveying square pipe 6 as a thin layer (e.g., a single layer of cut tobacco pieces and fine stems). The fine tobacco stems and pure tobacco are identified by the image recognition system 7. The fine stems are removed from the horizontal pneumatic conveying square pipe 6 by directing a burst or jet of compressed air from the compressed air spray tube 11 in the fine stem removal system 10 at the fine stems recognized by the image recognition system 7. The fine stems are then collected in the fine stem collecting cylinder 14, and then discharged through the fine stem collecting gas lock 15 and the fine stem collecting tube 16. The pure tobacco continues to move through the horizontal pneumatic conveying square pipe 6 into the cyclone separator 17, where the pure tobacco falls to the bottom of the cyclone separator 17 (e.g., due to the gas-solid separation function or capability of such cyclone separators), passes through the pure tobacco discharge gas lock 19, and falls onto the vibrating conveying feeding device 20. This completes the removal of fine and coarse stems from the cut or shredded tobacco.

Compared with the prior art, the present invention has the following beneficial effects:

1. The stem removal device of the present invention comprises a coarse stem removal unit and a fine stem removal unit, in which the coarse stems are removed by vertical (upward) air pressure (wind selection), and the fine stems are removed by image recognition and air bursts or jets from a precision nozzle (on the compressed air spray tube 11), typically for a short duration (e.g., <1 second), and the coarse stems and fine stems are removed successively, which can effectively remove all stems from the tobacco. It can effectively solve the problems that exist in the current flexible air separation device(s) and method(s) for removing stems adopted by cigarette manufacturers, such as poor removal of fine stems and high losses of tobacco.

2. The stem removal device of the present invention is designed with a flexible air selection unit before the stem removal, which makes full use of the density differences between the stems and the tobacco, separating most of the pure tobacco and retaining a small part as a mixture of cut tobacco and the stems, which can significantly increase the tobacco processing capacity and reduce or eliminating the damage to most of the tobacco that could result from the stem removal process. The present stem removal device is easily adaptable to mass production in a commercial cigarette production line.

3. The stem removal device of the present invention is designed to return the purified tobacco to the tobacco feed unit after removal of the coarse stems and the fine stems, so that the stems that have not been removed can be subject to further removal cycles, thereby achieving a highly efficient stem removal process and apparatus, thus significantly improving the use and value of the purified cut tobacco and stabilizing the quality of cigarette products manufactured therefrom.

4. The stem removal device of the present invention has the advantages of a relatively simple structure, a relatively practical method, and can be applied to the removal of other impurities in tobacco. The present device and method have good prospects for broad application and commercial value.

BRIEF DESCRIPTION OF THE DRAWINGS

In order to more clearly describe the technical scheme in the embodiments of the invention or the prior art, the following is a brief introduction of the drawing to be used in the description of the embodiments or the prior art. It is obvious that the drawing described below represents only some embodiments of the present invention. For ordinary technicians in the field, without creative labor, other drawings may also be obtained from the drawing.

FIG. 1 is a schematic diagram of the overall structure of the stem-removing device for a cigarette making process according to the present invention.

Description of the reference numbers in the drawing: N1—tobacco feeding unit; N2—flexible winnowing/separating unit; N3—pure tobacco collection unit; N4—tobacco-and-stem conveying unit; N5—coarse stem removal unit; N6—fine stem removal unit; 1—coarse stem collecting pipe; 2—coarse stem collecting gas lock; 3—coarse stem collecting cylinder; 4—separating device; 5—riser/lifting tube; 6—transverse/horizontal pneumatic conveying square pipe; 7—image recognition system; 8—image acquisition camera; 9—light source; 10—fine stem removal system; 11—compressed air pipe/tube; 12—high-speed solenoid valve; 13—detection and identification signal servo controller; 14—fine stem collecting cylinder; 15—fine stem collecting air lock; 16—fine stem collecting discharge pipe; 17—cyclone separator; 18—exhaust pipe; 181—exhaust pipe mouth/opening; 19—purified tobacco discharge air lock; 20—vibrating conveying feeding device; 21—hopper/funnel feeding device; 22—flexible air separator; 221—connecting port; 23—baffle; 24—dust removal device; 25—exhaust air pipe; 26—exhaust air outlet; 27—vibrating conveying and discharging device; 28—pure tobacco discharge pipe; 29—pure tobacco discharging air lock; 30—pure tobacco collection device; 31—pneumatic conveying inlet; 32—tobacco-and-stem blanking device; 33—tobacco-and-stem blanking gas lock; 34—tobacco-and-stem conveying/delivery pipe.

DETAILED DESCRIPTION

The present invention is further described in conjunction with the drawing and embodiments, but the technical solution of the present invention is not limited to the drawing and the described embodiments. Any transformation or improvement of tobacco stem removal equipment and processes based on the teachings of the present invention is within the scope of the present invention.

The terms "central," "middle," "left," "right," "upper," "above," "lower," "below," and other words indicating relative or absolute direction are intended to more clearly explain the technical scheme of the present invention, particularly with regard to the structures shown in the drawing, and are not a limitation of the present invention.

As shown in FIG. 1, a device for removing stems in the process of making cigarette-quality tobacco comprises a tobacco feeding unit N1, a flexible separating unit N2, a pure tobacco collection unit N3, a tobacco conveying unit N4, a coarse stem collecting unit N5, and a fine stem removal unit N6.

The tobacco feeding unit N1 is in the center of the stem removal device. Its left side as shown in FIG. 1 includes the flexible separating unit N2, its right side as shown in FIG. 1 is the coarse stem removal unit N5, its upper part as shown in FIG. 1 is the fine stem removal unit N6, and its lower part as shown in FIG. 1 is the tobacco feed port of the tobacco-and-stem conveying unit N4. The tobacco feeding unit N1 vibrates (to loosen and separate agglomerated cut tobacco leaves and stems) and conveys the incoming raw tobacco and tobacco after stem removal to the flexible separating unit N2 for a flexible separating process.

The flexible separating unit N2 may comprise a box or have a cuboid shape. The pure tobacco collection unit N3 is positioned at its lower left bottom, and the tobacco blanking device 32 containing the tobacco-and-stem conveying unit N4 is positioned at its lower right bottom. The flexible separating unit N2 separates pure tobacco from a tobacco-and-stem mixture conveyed by the tobacco feeding unit N1, conveys the separated pure tobacco to the pure tobacco collection unit N3 for collection, and collects the tobacco-and-stem mixture in the tobacco conveying unit N4 for conveying the tobacco-and-stem mixture to the coarse stem removal unit N5. The pure tobacco collection unit N3 collects the separated pure tobacco. The tobacco conveying unit N4 conveys the tobacco-and-stem mixture from the flexible separating unit N2, and the tobacco-and-stem mixture is pneumatically transported to the coarse stem removal unit N5 to carry out the coarse stem removal process. The fine stem removal unit N6 carries out image recognition and precise air injection removal of the fine stems in the tobacco, and the tobacco after removing the coarse and fine stems is conveyed to the tobacco feeding unit N1 for circulating again in the stem removal process. Most, if not all, of the tobacco with the coarse and fine stems removed is expected to be collected in the pure tobacco collection unit N3 in the next flexible air sorting cycle in the flexible sorting unit N2.

Tobacco moves through each unit in the following sequence: raw tobacco passes through the tobacco feeding unit N1, enters the flexible separating unit N2, and pure tobacco is collected in the pure tobacco collection unit N3. The remaining mixture of tobacco with stems enters into the tobacco conveying unit N4, then into the coarse stem removal unit N5 and the fine stem removal unit N6, and after the stems are removed, the tobacco is recirculated to the tobacco feeding unit N1 and the flexible separating unit N2, and most (e.g., >50% or more) of the tobacco with the stems removed is collected in the pure tobacco collection unit N3.

The tobacco feeding unit N1 comprises a vibrating conveying feeding device 20 and a funnel feeding device 21 above the vibrating conveying feeding device 20. The vibrating conveying feeding device 20 extends obliquely upward to the flexible separating box 22. The tobacco feeding unit N1 and the connection port 221 into the flexible separating box 22 is on the lower right side of the flexible separating box 22 in the flexible separating unit N2 as shown in FIG. 1.

The flexible separating unit N2 comprises the flexible separating box 22, a baffle (e.g., a baffle plate) 23, a dust removal device 24, and a vibrating conveying discharging device 27. The baffle 23 is in the middle on the top inner wall of the flexible separating box 22, and to the upper left of the connecting port 221, as shown in FIG. 1. The dust removal device 24 is at the top left corner of the flexible separating box 22 as shown in FIG. 1, and the exhaust outlet 26 and the exhaust pipe 25 extend into the flexible separating box 22. The vibrating conveying and discharging device 27 is above a space between the pure tobacco collection unit N3 and the tobacco conveying unit N4 as shown in FIG. 1, at the bottom of the flexible separating box 22. The vibrating conveying and discharging device 27 is arranged obliquely upward from the tobacco-and-stem conveying unit N4 to the pure tobacco collection unit N3. The end of the vibrating conveying discharging device 27 towards the pure tobacco collection unit N3 is adjacent to and/or over the pure tobacco discharge pipe 28, which is connected with the pure tobacco collection unit N3 through the pure tobacco discharging gas lock 29. The end of the vibrating conveying discharging device 27 towards the tobacco-and-stem conveying unit N4 is below and outside the mouth of the tobacco blanking device 32.

The pure tobacco collection unit N3 comprises the pure tobacco collection device 30, the pure tobacco discharge gas lock 29 connected to the pure tobacco collection device 30, and the pure tobacco discharge pipe 28 below the pure tobacco discharge gas lock 29.

The tobacco conveying unit N4 comprises a horizontal tobacco-and-stem conveying pipe 34, which may be tubular, and which may have an upper wall at one end connected with the tobacco blanking device 32 through the tobacco blanking gas lock 33. A first port of the tobacco-and-stem conveying pipe 34 includes a pneumatic conveying inlet 31, which is connected to a positive pressure air generating device.

The coarse stem removal unit N5 comprises a vertical separating device 4, a riser/pipe 5 and a coarse stem collecting cylinder 3. The riser 5 may be horn- or trumpet-shaped. The separating device 4 is cylindrical, and has an upper port connected with an opening in the end of riser/pipe 5, and a lower port connected with the coarse stem collecting cylinder 3. The coarse stem collecting cylinder 3 is connected with the coarse stem collecting gas lock 2, which is connected in turn to the coarse stem collecting pipe 1. One end (e.g., adjacent to the separating device 4) of the tobacco-and-stem conveying pipe 34 may be bent (e.g., upwards) by 90° or thereabout. A port at the one end of the tobacco-and-stem conveying pipe 34 is connected to a side wall of the separating device 4 (e.g., in the middle and/or lower part[s] thereof).

The fine stem removal unit N6 comprises the transverse pneumatic conveying square pipe 6, the image recognition system 7, the fine stem rejection system 10, the fine stem collecting cylinder 14 and the cyclone separator 17. The transverse pneumatic conveying square pipe 6 may be transparent, square (e.g., having a substantially square cross-section) and/or horizontal. The image recognition system 7 comprises an image acquisition camera 8 and a light source 9. The fine stem rejection system 10 comprises a compressed air blowing pipe 11 (receiving an output of a compressed air source, such as a compressed air tank), a high-speed solenoid valve 12, and a detection and identification signal servo controller 13. The image recognition system 7 is upstream of and close to the fine stem rejection system 10, and both are above (e.g., on top of, but exposed to an interior of) the transverse pneumatic conveying square pipe 6. The fine stem collecting cylinder 14 is below the transverse pneumatic conveying pipe 6, and has an upper port connected to the interior of the transverse pneumatic conveying pipe 6 and a lower port or end connected to the fine stem collecting pipe 16 through the fine stem collecting gas lock 15. The upper port of the fine stem collecting cylinder 14 is opposite from the fine stem rejection system 10 across the conveying pipe 6. The cyclone separator 17 is vertically arranged, and has a lower port coupled to the vibrating conveying feeding device 20 through the purified tobacco discharge gas lock 19, and an upper port connected to the exhaust pipe 18. The exhaust pipe 18 is connected to the wall of the flexible separating box 22, below the connecting port 221 and above the tobacco blanking device 32. The exhaust pipe mouth or opening 181 is inclined to (e.g., faces) the upper left corner of the flexible separating box 22 as shown in FIG. 1. The entry port of the transverse pneumatic conveying square pipe 6 may communicate with the riser 5, and the exit port of the transverse pneumatic conveying square pipe 6 may communicate with and be connected to the wall of the cyclone separator 17 (e.g., in a middle and/or upper part thereof).

The baffle 23 may be adjustable horizontally (e.g., along the left and right directions as shown in FIG. 1) to adjust the air flow direction in the flexible separating unit N2 and the corresponding separation process.

The tobacco from which the stems are removed (e.g., in the process of cigarette making) is one or more of raw cut or shredded tobacco, tobacco containing stems, and finished tobacco (e.g., in a cigarette-making production line).

From the pneumatic conveying inlet 31 into the tobacco-and-stem conveying pipe 34, air may be introduced at a positive pressure, velocity or speed in the range of 8.0 m/s~15.0 m/s. In one embodiment, this velocity or speed is 13.0 m/s.

From the tobacco-and-stem conveyor pipe 34 into the separating device 4, the air flow may have a positive pressure, velocity or speed in the range of 2.0 m/s~6.0 m/s. In one embodiment, this velocity or speed is 3.0 m/s.

From the riser 5 into the transverse pneumatic conveying square pipe 6, the air flow may have a positive pressure, velocity or speed in the range of 13.0 m/s~23.0 m/s. In one embodiment, this velocity or speed is 17.0 m/s.

The positive pressure air flow in the present stem removal device may move or have a trajectory as follows: the positive pressure air flow enters the tobacco-and-stem conveying pipe 34 through the pneumatic conveying inlet 31, then flows into the separating device 4 along the tobacco-and-stem conveying pipe 34, then moves upwards through the separating device 4, enters the transverse pneumatic conveying pipe 6 through the lifting tube 5, then continues to move along the transverse pneumatic conveying square pipe 6 to the cyclone separator 17, then after passing through the cyclone separator 17 and into the exhaust pipe 18, enters the flexible separating box 22 from the exhaust pipe mouth 181, and then flows through the flexible separating box 22 (e.g., through the upper left corner of the flexible separating box 22 as shown in FIG. 1). At least a portion of the positive pressure air flows into the exhaust air outlet 26 and is discharged through the exhaust pipe 25 into the dust removal device 24, where it may exit the stem removal device or be recovered for further use elsewhere (e.g., in the stem removal device or outside the stem removal device).

The method of removing stems (e.g., in the process of cigarette making) using the stem removal device of the present invention comprises the following steps:

Raw tobacco falls from the funnel feeding device 21 onto the vibrating conveying feeding device 20 and enters the flexible separating box 22 after being conveyed upward obliquely and being vibrated on the vibrating conveying device 20. Due to the oblique upward positive pressure air flow that enters the flexible separating box 22 through the exhaust pipe 18 and the force of gravity, the raw tobacco is fully loosened and separated into two parts: A majority portion (e.g., >50%, such as ≥70%, 80%, or more) of pure tobacco and a smaller (reminder) part or portion containing a tobacco and stem mixture. The pure tobacco moves to the left in the flexible separating box 22 as shown in FIG. 1, falls on the vibrating conveying discharging device 27 due to the effect of gravity (i.e., its own weight), and is then conveyed to the pure tobacco discharge pipe 28, and finally collected in the pure tobacco discharge gas lock 29 and discharged through the pure tobacco collecting device 30.

After being separated by the flexible separating box 22, the tobacco and stem mixture fall into the tobacco blanking device 32 by its own weight (gravity), and enters the tobacco-and-stem conveying pipe 34 through the tobacco-and-stem blanking air lock 33. After transferring through the conveying pipe 34, the mixture of tobacco and stems separates into two parts in the vertical separating device 4; coarse stems that fall to the bottom of the vertical separating device 4 and are collected in the coarse stem collecting cylinder 3, then discharged through the coarse stem collecting air lock 2 into the coarse stem collecting discharge pipe 1, and a mixture of tobacco and fine stems.

The mixture of tobacco and fine stems moves to the top of the vertical separating device 4 due to the positive air flow through the vertical separating device 4, and enters into the transverse pneumatic conveying square pipe 6 through the riser 5. The fine stems are identified by the image recognition system 7 and are rejected downward by a short, optionally focused jet of compressed air from the compressed air injection pipe 11 into the thin stem collecting cylinder 14, where they are discharged through the fine stem collecting gas lock 15 into the fine stem collecting discharge pipe 16. The purified tobacco continues to move to the left as shown in the diagram of FIG. 1 along the transverse pneumatic conveying pipe 6 into the cyclone separator 17, where the purified tobacco falls into the bottom of the cyclone separator 17 (e.g., under the effect of gas-solid separation in such cyclone separators), and falls on the vibrating conveying feeding device 20 after passing through the purified tobacco discharge gas lock 19. The purified shredded tobacco with the stems removed may comprise dried, shredded tobacco, and the present process may be a key process in cigarette tobacco shredding and/or shredded tobacco preparation.

In one example, 3000 kg of tobacco (after drying and shredding), typically used to make a commercial brand of cigarettes, has a stem content of 7.12% (detected by using SST-2 type tobacco stem content tester).

The tobacco is divided into two equal parts (1500 kg each). The present stem removal device and (in comparison) a current production line FS417A type leaf flexible in-situ separating machine, respectively, are used to remove the tobacco from the stems. The results are shown in Table 1. The SST-2 tobacco stem content tester was used to detect the stem content in the tobacco after the two treatments. The quantity of the stems removed was weighed using an electronic balance, and the effective removal rate of the stem was calculated as (the stem content in the tobacco before treatment−the stem content in the tobacco after treatment)/the stem content in the tobacco before treatment×100%.

TABLE 1

Comparison of the results of the present invention and the FS417A type leaf filament flexible in-situ separating machine to remove the stems

| Processing equipment | Quantity of removed stems (kg) | Stem content after treatment | Effective removal rate |
|---|---|---|---|
| FS417A type flexible separating machine | 41.10 | 4.38% | 38.48% |
| The present invention | 100.05 | 0.45% | 93.68% |

From Table 1, it can be seen that, when compared with the current FS417A type leaf flexible separating machine, the device of the present invention removes significantly more stems from the same tobacco, under the same conditions. The tobacco stem removal effect is better, the effective stem removal rate of is 93.68%, meaning that the tobacco is nearly ten times purer after treatment with the present invention (i.e., only 6.32% of stems remaining vs. 61.52% of stems remaining after treatment with the FS417A type leaf flexible separating machine). The present device can efficiently remove stems in the process of cigarette making, significantly reduce the harm of the stems to the subsequent tobacco rolling process and the final cigarette product quality, and can improve and stabilize the quality of cigarette products.

The above is presented only to detail the specific embodiment(s) of the present invention, but the technical solution proposed by the present invention is not limited by the above description. On the premise that it does not deviate from the basic principles of the present art, equivalent modifications and changes made by those skilled in the art to the technology in the present invention shall be considered covered by the scope of the claims of the present application.

What is claimed is:

1. A stem removal device for a cigarette making process, comprising a feeding unit (N1), a flexible air sorting unit (N2), a pure tobacco collection unit (N3), a tobacco conveying unit (N4), a coarse stem removal unit (N5) and a fine stem removal unit (N6), wherein:

the tobacco feeding unit (N1) is in a center of the stem removal device, the flexible air sorting unit (N2) is on a first side of the stem removal device, the coarse stem removal unit (N5) is on a second side of the stem removal device, the fine stem removal unit (N6) is on a third side is of the stem removal device, and a tobacco-and-stem feed port of the tobacco conveying unit (N4) is on a fourth side of the stem removal device;

the flexible air sorting unit (N2) comprises a rectangular box, the pure tobacco collection unit (N3) is below the rectangular box, and the tobacco conveying unit (N4) includes a tobacco blanking device (32) below or at a lower side of the rectangular box; and raw tobacco enters the tobacco feeding unit (N1), the flexible air sorting unit (N2), then pure tobacco is collected in the pure tobacco collection unit (N3); remaining tobacco with stems goes into the tobacco conveying unit (N4), then into the coarse stem removal unit (N5) and the fine stem removal unit (N6), then into the flexible air sorting unit (N2) and into the pure tobacco collection unit (N3), wherein:

the feeding unit (N1) comprises a vibrating conveying feeding device (20) and a funnel feeding device (21) above the vibrating conveying feeding device;

the vibrating conveying feeding device (20) extends obliquely to a flexible air separator (22);

the tobacco feeding unit (N1) and the flexible air separator (22) have a connecting port (221) beside the flexible air sorting unit (N2);

the flexible air sorting unit (N2) comprises the flexible air separator (22), a baffle (23), a dust removal device (24) and a vibrating conveying discharge device (27), wherein the baffle (23) is on a top wall in a middle of the flexible air separator (22) and above and to a side of the connection port (221);

the dust removal device (24) is above the flexible air separator (22), and an exhaust air outlet (26) is in the flexible air separator (22) through an exhaust air pipe (25);

the vibrating conveying discharge device (27) is between the pure tobacco collection unit (N3) and the tobacco conveying unit (N4), and is diagonally tilted, and has a first end adjacent to a pure tobacco discharge pipe (28) and a second end adjacent to the tobacco blanking device (32), and the pure tobacco collection unit (N3) is connected through a pure tobacco discharge air lock (29);

the pure tobacco collection unit (N3) comprises a pure tobacco collection device (30), and the pure tobacco collection device (30) is connected to the pure tobacco discharge pipe (28) through the pure tobacco discharge gas lock (29);

the tobacco conveying unit (N4) comprises a horizontal tobacco-and-stem conveying pipe (34);

the tobacco-and-stem conveying pipe (34) is tubular, with an upper wall connected at one end with the tobacco blanking device (32) through a tobacco blanking air lock (33), and a port connected with a positive pressure air generating device for a pneumatic conveying inlet (31);

the coarse stem removal unit (N5) comprises a vertically-configured air sorting device (4), a lifting tube (5) and a coarse stem collecting cylinder (3);

the lifting tube (5) is hornshaped;

the air sorting device (4) is cylindrical, and has an upper port which is connected with an opening of the lifting tube (5), and a lower port which is connected with the coarse stem collecting cylinder (3);

the coarse stem collecting cylinder (3) is connected with the coarse stem collecting pipe (1) through the coarse stem collecting gas lock (2);

the tobacco-and-stem conveying pipe (34) has a 90° upward bend, and a port which is connected to a side wall of the air sorting device (4);

the fine stem removal unit (N6) comprises a horizontal pneumatic conveying square pipe (6), an image recognition system (7), a fine stem removal system (10), a fine stem collecting cylinder (14) and a cyclone separator (17);

the horizontal pneumatic conveying square pipe (6) comprises a horizontally-configured transparent square tube;

the image recognition system (7) comprises an image acquisition camera (8) and a light source (9);

the fine stem removal system (10) comprises a compressed air spray pipe (11), a high-speed solenoid valve (12) and a detection and identification signal servo controller (13);

the image recognition system (7) is upstream of the fine stem removal system (10), and the image recognition system (7) and the fine stem removal system (10) are above the horizontal pneumatic conveying square pipe (6);

the fine stem collecting cylinder (14) is below the horizontal pneumatic conveying square pipe (6), and has an upper end which is connected with the horizontal pneumatic conveying square pipe (6) and a lower end which is successively connected with a fine stem discharge air lock (15) and a fine stem discharge pipe (16);

the fine stem removal system (10) is opposite to an upper end of the fine stem collecting cylinder (14);

the cyclone separator (17) is vertically configured, and has a lower port which is connected with the vibrating conveying feeding device (20) through a purified tobacco discharge gas lock (19) and an upper port which is connected with an exhaust pipe (18);

the exhaust pipe (18) has a 180° bend, is connected to a wall between the connection port (221) and the tobacco blanking device (32), and has an outlet (181) facing upwardly;

the horizontal pneumatic conveying square pipe (6) has a first port is connected with an upper port of the lifting tube (5), and a second port connected with a wall of the cyclone separator (17).

2. The stem removal device of claim 1, wherein the baffle (23) is horizontally adjustable.

3. The stem removal device of claim 2, wherein the pneumatic conveying inlet (31) provides a positive pressure air velocity into the tobacco-and-stem conveying pipe (34) that ranges from 8.0 m/s to 15.0 m/s.

4. The stem removal device of claim 1, wherein the stem-label tobacco-and-stem conveying pipe (34) provides a positive pressure air velocity into the air sorting device (4) that ranges from 2.0 m/s to 6.0 m/s.

5. The stem removal device of claim 1, wherein the lifting tube (5) provides a positive pressure air velocity into the horizontal pneumatic conveying square pipe (6) that ranges from 13.0 m/s to 23.0 m/s.

6. A method for removing stems in the cigarette making process using the stem removal device of claim 1, wherein:

a positive pressure wind or air flow enters the tobacco-and-stem conveying pipe (34) through the pneumatic conveying inlet (31), then flows along the tobacco-and-stem conveying pipe (34) into the air sorting device (4), then moves upward along the air sorting device (4), and enters the horizontal pneumatic conveying square pipe (6) through the lifting tube (5), then it continues to move along the horizontal pneumatic conveying square pipe (6) into the cyclone separator (17), and then along the exhaust pipe (18) through the exhaust pipe outlet (181) into the flexible air separator (22), then into the exhaust outlet (26) and is discharged through the exhaust air pipe (25) and the dust removal device (24); and the method for removing the stem in the cigarette making process comprises the following steps:

dropping raw material tobacco onto the vibrating conveying feeding device (20) from the funnel feeding device (21), vibrating the vibrating conveying feeding device (20), and entering the raw material tobacco into the flexible air separator (22);

inclining positive pressure air upward and entering raw tobacco into the flexible air separator (22) through the exhaust pipe (18), then separating the raw tobacco into a major part of pure tobacco and a small part comprising a mixture of tobacco and stems, wherein the pure tobacco falls onto the vibrating conveying discharge device (27);

transmitting the pure tobacco to the pure tobacco discharge pipe (28), and passing the pure tobacco through the pure tobacco discharge air lock (29) to the pure tobacco collection device (30);

collecting the small part separated by the flexible air separator (22) in the tobacco blanking device (32), and passing the small part through the tobacco blanking air lock (33);

entering the small part into the tobacco-and-stem conveying pipe (34);

entering the positive pressure wind or air flow from the pneumatic conveying inlet (31) and flowing the small part along the tobacco-and-stem conveying pipe (34) to enter the vertical air sorting device (4), fully and loosely separating the small part into coarse stems and a mixture of cut tobacco and fine stems, wherein the coarse stems descend in the vertical air sorting device (4) and are discharged through the coarse stem collecting cylinder (3), the coarse stem collecting gas lock (2) and the coarse stem collecting pipe (1), moving the mixture of cut tobacco and fine stems towards a top of the vertical air sorting device (4) using the positive pressure wind or air flow, and entering the mixture of cut tobacco and fine stems into the horizontal pneumatic conveying square pipe (6) through the lifting tube (5), identifying the mixture of cut tobacco and fine stems with the image recognition system (7), removing the fine stems using the compressed air spray tube (11) under the fine stem removal system (10) into the fine stem collecting cylinder (14), and discharging the fine stems through the fine stem discharge gas lock (15) and the fine stem discharge tube (16), moving the cut tobacco along the horizontal pneumatic conveying square pipe (6) into the cyclone separator (17), collecting the cut tobacco in a bottom of the cyclone separator (17), and dropping the cut tobacco through the purified tobacco discharge gas lock (19) onto the vibrating conveying feeding device (20), thereby completing removal of the coarse stems and the fine stems.

* * * * *